US011306997B2

(12) United States Patent
Huang

(10) Patent No.: US 11,306,997 B2
(45) **Date of Patent: *Apr. 19, 2022**

(54) THROWING DEVICE WITH TWO-STAGE PROPULSION SYSTEM

(71) Applicant: Jian-Lin Huang, Tainan (TW)

(72) Inventor: Jian-Lin Huang, Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,055

(22) Filed: Aug. 11, 2020

(65) Prior Publication Data

US 2022/0049928 A1 Feb. 17, 2022

(51) Int. Cl.

| | |
|---|---|
| ***F41F 3/045*** | (2006.01) |
| ***F42B 15/10*** | (2006.01) |
| ***F42B 3/16*** | (2006.01) |
| *A62C 19/00* | (2006.01) |

(52) U.S. Cl.

CPC ..... *F41F 3/045* (2013.01); *F42B 3/16* (2013.01); *A62C 19/00* (2013.01); *F42B 15/10* (2013.01)

(58) Field of Classification Search

CPC .... F42B 5/16; F42B 8/24; F42B 15/00; F42B 15/36; F02K 9/28; F02K 9/30; F02K 9/36; F02K 9/76; F02K 9/763; F41F 3/045; F41F 3/0455

See application file for complete search history.

(56) References Cited

U.S. PATENT DOCUMENTS

| | | | | |
|---|---|---|---|---|
| 2,442,528 A * | 6/1948 | Beattle | F42B 12/68 | 102/340 |
| 2,500,117 A * | 3/1950 | Chandler | F42B 10/30 | 60/201 |
| 2,856,851 A * | 10/1958 | Thomas | F42B 15/36 | 102/374 |
| 2,968,245 A * | 1/1961 | Sutton | F42B 10/30 | 244/3.23 |
| 3,292,302 A * | 12/1966 | Estes | A63H 27/005 | 446/212 |
| 3,388,666 A * | 6/1968 | Walther | F42B 5/105 | 102/377 |

(Continued)

OTHER PUBLICATIONS

Optimal Staging Delay. The Rocketry Forum. <https://www.rocketryforum.com/threads/optimal-staging-delay.20286/>. 2011. (Year: 2011).*

(Continued)

*Primary Examiner* — Gabriel J. Klein
(74) *Attorney, Agent, or Firm* — Rosenberg, Klein & Lee

(57) ABSTRACT

The present disclosure provides a throwing device with a launcher and a propulsion system. The propulsion system comprises a retardant set between two sections of propellant for delaying the combustion and reducing the generated smoke or heat while launching the propulsion system. The launcher comprises: a tube for containing the propulsion system; and a trigger for triggering the ignition cartridge. A screw hole is in center of a bottom of the first chamber; nozzles are located around the screw hole; and a collar with a hole fixed in the bottom of the first chamber, wherein the ignition cartridge is fixed in the screw hole by the collar. The ignition cartridge comprises an explosive primer, and the launcher further comprises a firing pin triggered by the trigger to hit the explosive primer.

19 Claims, 7 Drawing Sheets

(56) References Cited

U.S. PATENT DOCUMENTS

| | | | | | |
|---|---|---|---|---|---|
| 3,721,193 | A * | 3/1973 | Piester | F02K 9/763 | 102/352 |
| 3,886,841 | A * | 6/1975 | Smith | F42B 5/105 | 89/1.3 |
| 3,922,967 | A * | 12/1975 | Mertens | F42C 15/22 | 102/439 |
| 4,355,577 | A * | 10/1982 | Ady | C06B 31/08 | 102/287 |
| 5,160,070 | A * | 11/1992 | Hibler | F02K 9/28 | 60/250 |
| 8,826,822 | B1 * | 9/2014 | Huang | F42B 15/00 | 102/352 |
| 9,021,957 | B1 * | 5/2015 | Farina | F42B 15/10 | 102/376 |
| 9,664,142 | B1 * | 5/2017 | Huang | F02K 9/28 | |

OTHER PUBLICATIONS

Easy PVC Rockets. Jason Smiley. <http://ftp.demec.ufpr.br/foguete/bibliografia/Easy%20PVC%20Rockets-Book.pdf>. 2005. (Year: 2005).*

Richard Nakka's Experimental Rocketry Web Site. Igniter Systems. <https://web.archive.org/web/20170213190337/https://www.nakka-rocketry.net/igniter.html>. Feb. 13, 2017. (Year: 2017).*

Homemade Bazooka Has Earned Its Stripes. Kristina Panos, <https://hackaday.com/2014/07/18/homemade-bazooka-has-earned-its-stripes/>. Jul. 18, 2014. (Year: 2014).*

Sorbitol & Potassium Nitrate Rocket Propellant. <https://web.archive.org/web/20180918000731/http://www.doranaerospace.com/Sorbitol.html>. Sep. 18, 2018. (Year: 2018).*

* cited by examiner

THROWING DEVICE WITH TWO-STAGE PROPULSION SYSTEM

TECHNICAL FIELD

The present disclosure relates to a throwing device with a two-stage propulsion system, especially, using the solid fuel.

DISCUSSION OF THE BACKGROUND

Throwing devices, for example, rockets, take essential parts in the battle field. Today, throwing devices also take essential parts in our lives. As the solid fuel becomes popular and safer, it also changes types of the propulsion system of the throwing device.

For example, a throwing device with a fire-extinguishing rocket can be used to handle blazes far away from an operator. The throwing device, which may have a rocket launcher, can fire a rocket filled with a fire-extinguishing agent to hit the fire source dozens of floors up. The rocket is capable of going through the window and spreading the fire-extinguishing agent inside a house. Therefore, the operator can put out the fire without getting into the house. As another example, a throwing gun may also have a rocket launcher as the propulsion system to make a rope reach a far place. However, while the propulsion system is launched, lots of smoke and heat may be produced and emitted, and it may harm people who stand nearby. Therefore, an invention for the throwing device to avoid such risk is required.

SUMMARY

One aspect of the present disclosure provides a throwing device comprising: a propulsion system and a launcher. The propulsion system comprises: a first section comprising a first chamber containing a first propellant, and an igniter for igniting the first propellant; a second section that is connected to the first section and comprises a second chamber containing a second propellant; and a retardant set between the first propellant and the second propellant for delaying the combustion from the first propellant to the second propellant. The launcher comprising: a tube for containing the propulsion system; and a trigger for triggering the igniter.

By delaying the combustion from the first propellant to the second propellant, the propellant will not be burned at once, and the emitted smoke and heat can be decreased. Thus, people who stand nearby will be safe.

Another aspect of the present disclosure provides a throwing device comprising: a propulsion system and a launcher. The propulsion system comprises: a first section comprising a first chamber containing a first propellant, and an ignition cartridge for igniting the first propellant; a second section that is connected to the first section and comprises a second chamber containing a second propellant; and a retardant set between the first propellant and the second propellant for delaying the combustion from the first propellant to the second propellant. The launcher comprises: a tube for containing the propulsion system; and a trigger for triggering the ignition cartridge. Optionally, a screw hole is in center of a bottom of the first chamber; nozzles are located around the screw hole; and a collar with a hole fixed under the bottom of the first chamber, wherein the ignition cartridge is fixed in the screw hole by the collar. Optionally, the ignition cartridge comprises an explosive primer, and the launcher further comprises a firing pin triggered by the trigger to hit the explosive primer. Optionally, the launcher further comprises ignition coils controlled by the trigger to ignite the explosive primer.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

Figure 1B:
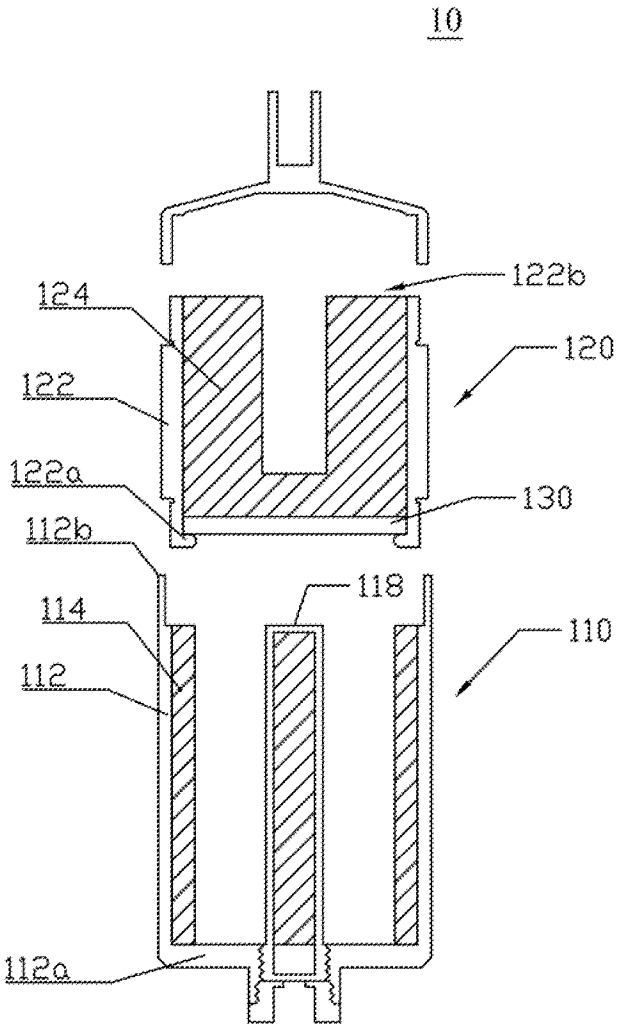
FIG. 1A is a side view and FIG. 1B is a cross-sectional view showing a propulsion system in accordance with an embodiment of the present disclosure.

Embodiments, or examples, of the disclosure illustrated in the drawings are now described using specific language. It shall be understood that no limitation of the scope of the disclosure is hereby intended. Any alteration or modification of the described embodiments, and any further applications of principles described in this document, are to be considered as normally occurring to one of ordinary skill in the art to which the disclosure relates. Reference numerals may be repeated throughout the embodiments, but this does not necessarily mean that feature(s) of one embodiment apply to another embodiment, even if they share the same reference numeral.

It shall be understood that, although the terms first, second, third, etc. may be used herein to describe various elements, components, regions, layers or sections, these elements, components, regions, layers or sections are not limited by these terms. Rather, these terms are merely used to distinguish one element, component, region, layer or section from another region, layer or section. Thus, a first element, component, region, layer or section discussed below could be termed a second element, component, region, layer or section without departing from the teachings of the present inventive concept.

The terminology used herein is for the purpose of describing particular example embodiments only and is not intended to be limited to the present inventive concept. As used herein, the singular forms "a," "an" and "the" are intended to include the plural forms as well, unless the context clearly indicates otherwise. It shall be further understood that the terms "comprises" and "comprising," when used in this specification, point out the presence of stated features, integers, steps, operations, elements, or components, but do not preclude the presence or addition of one or more other features, integers, steps, operations, elements, components, or groups thereof.

Figure 1A:
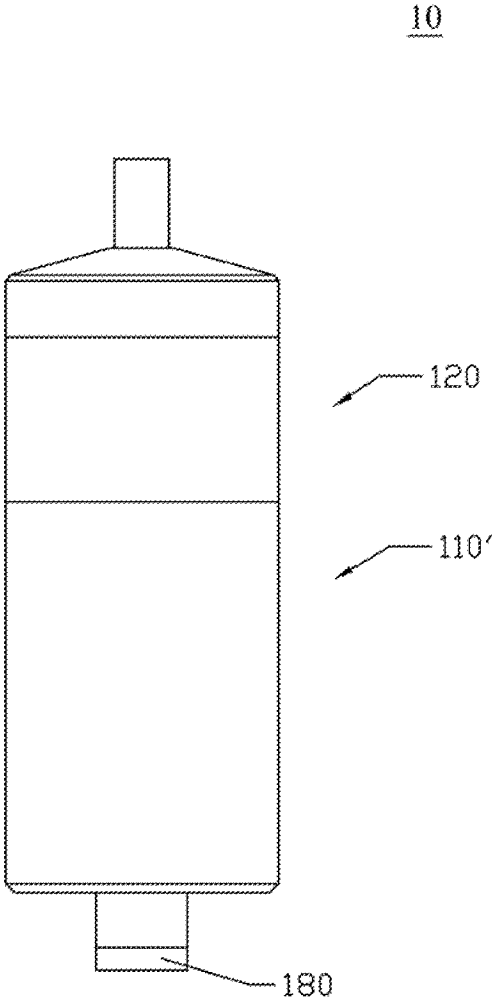

FIG. 1A is a side view and FIG. 1B is a cross-sectional view showing a propulsion system 10 in accordance with an embodiment of the present disclosure. By referring to FIGS. 1A and 1B, the propulsion system 10 comprises a first section 110, a second section 120, and a retardant set 130. Each of the first section 110, the second section 120, and the retardant set 130 may contain propellants, and the heat fluxes eject from a chamber bottom 112*a* of the first section 110.

FIG. 1B is a cross-sectional view showing a propulsion system 10 disassembled into the first section 110, the second section 120, and the retardant set 130 in accordance with the embodiment of the present disclosure. The first section 110 may comprise a first chamber 112 containing an ignition cartridge 118 and a first propellant 114. The second section 120 is connected to the first section 110 and comprises a second chamber 122 containing a second propellant 124. The retardant set 130 is positioned between the first propellant 114 and the second propellant 124 for delaying the combustion from the first propellant 114 to the second propellant 124.

Figure 2B:
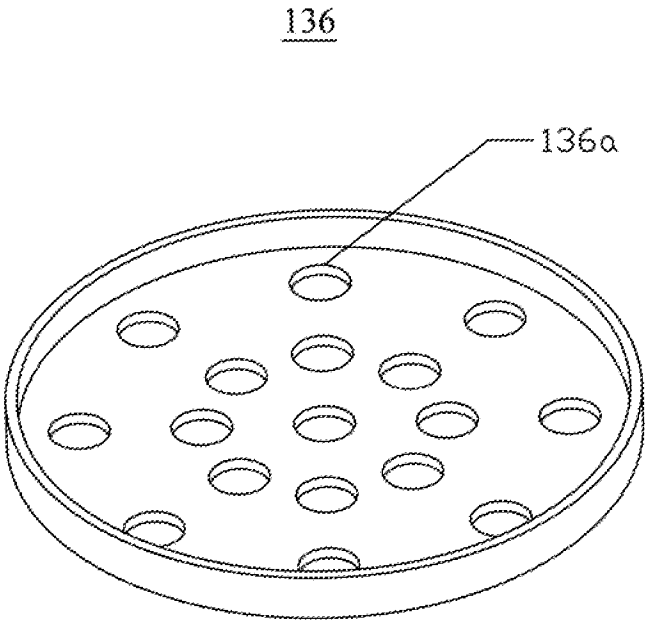
FIG. 2B is a perspective view showing the dish with holes in its bottom in accordance with yet another embodiment of the present disclosure.
Figure 2A:
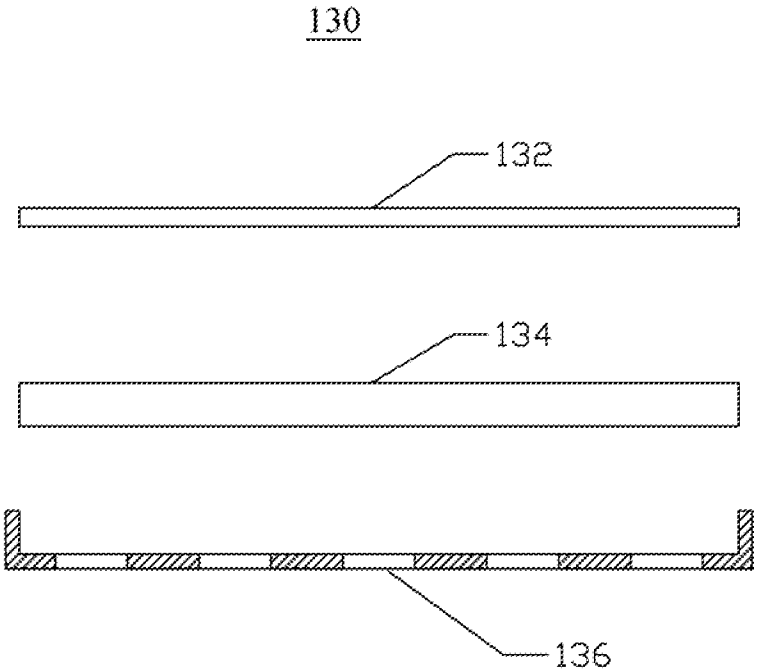
FIG. 2A is a cross-sectional view showing a retardant set comprising a dish, a third propellant, and a mesh in accordance with another embodiment of the present disclosure.

FIG. 2A is a cross-sectional view showing the retardant set 130 disassembled into a dish 136, a third propellant 134, and a mesh 132 in accordance with another embodiment of the present disclosure. FIG. 2B is a perspective view showing the dish 136 with holes 136*a* in its bottom in accordance with yet another embodiment of the present disclosure. By referring to FIG. 2A, the third propellant 134 may be contained by the dish 136, and may be covered by the mesh 132. Optionally, the third propellant 134 may comprise Sorbitol, Potassium Nitrate, and Iron Oxide. Alternatively, the third propellant 134 may be the solid fuel with a low regression rate. For example, the third propellant 130 may comprise Sorbitol, Potassium Nitrate, and Sodium Bicarbonate. Moreover, the Sodium Bicarbonate to the Sorbitol and the Potassium Nitrate may be about 15 to 100 in weight, and a ratio of Sorbitol to Potassium Nitrate is about 35 to 65 in weight.

Figure 3:
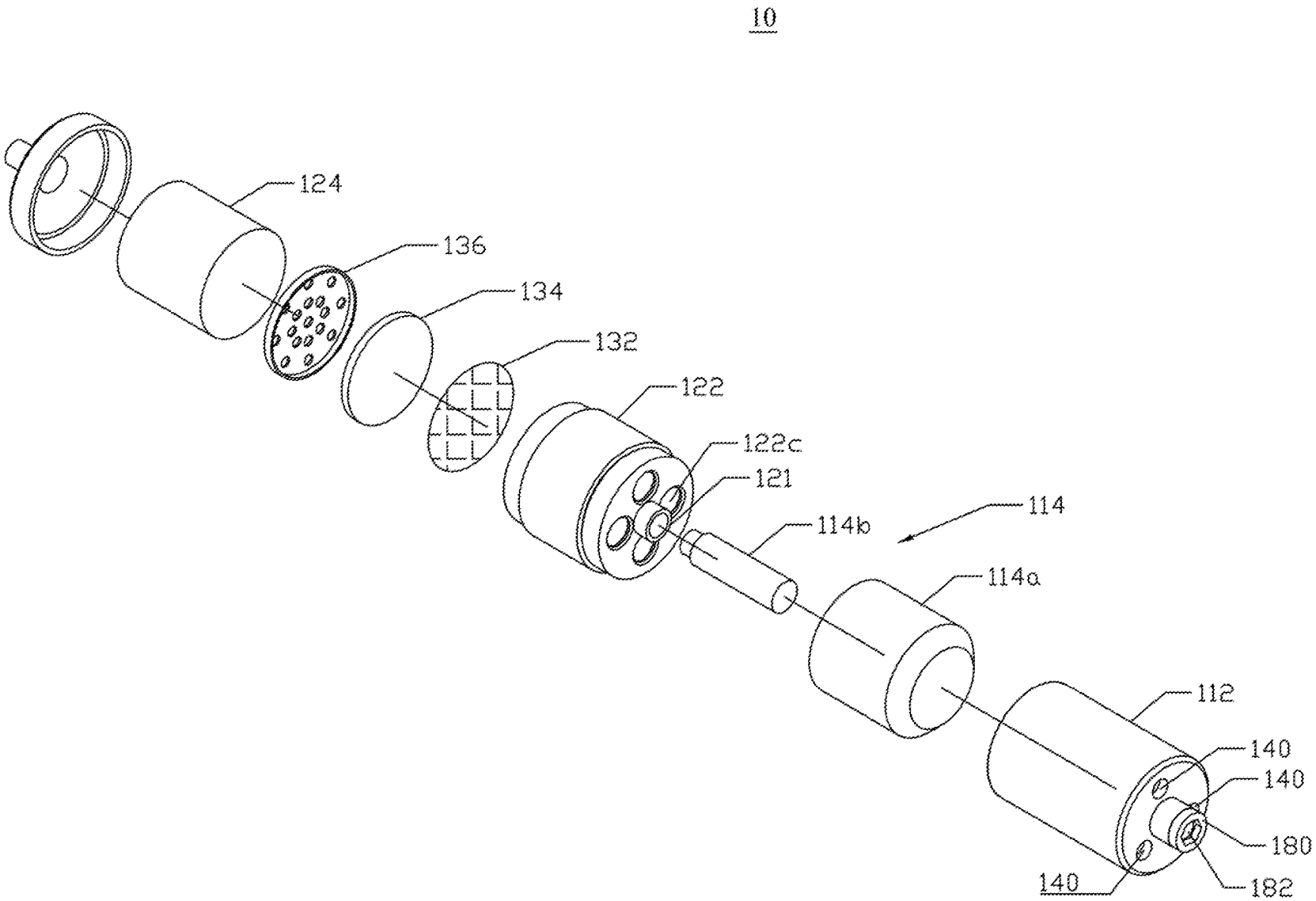
FIG. 3 is an exploded view of the propulsion system in accordance with yet another embodiment of the present disclosure.

FIG. 3 is an exploded view of the propulsion system 10 in accordance with yet another embodiment of the present disclosure. By referring to FIGS. 2A and 3, the retardant set 130 faces to the first propellant 114 by the mesh 132, and the retardant set 130 faces to the second propellant 124 by the dish 136.

Figure 4:
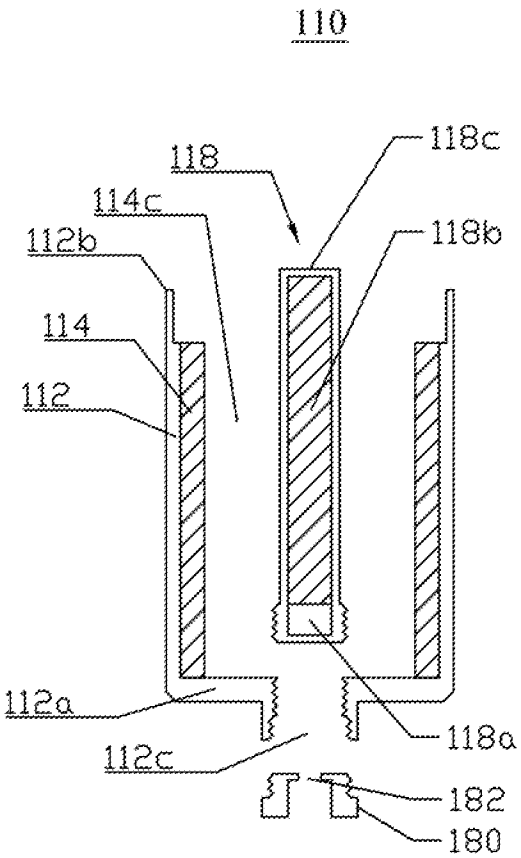
FIG. 4 is a cross-sectional view showing the first section in accordance with a further embodiment of the present disclosure.

FIG. 4 is a cross-sectional view showing the first section 110 in accordance with a further embodiment of the present disclosure. Optionally, the first chamber 112 may comprise an open top 112*b* and a bottom 112*a*. An ignition cartridge 118 is installed in the bottom 112*a* and fixed by a collar 180. The ignition cartridge 118 may comprise an explosive primer 118*a*, a cartridge propellant 118*b*, and a shell 118*c*. The first propellant 114 may comprise one or more combustion channels 114*c*. Optionally, the first propellant 114 comprises Sorbitol, Potassium Nitrate, and Iron Oxide, and a ratio of Sorbitol to Potassium Nitrate of the first propellant 114 is about 35 to 65 in weight.

By referring to FIGS. 3 and 4, a screw hole 112*c* is in center of a bottom 112*a* of the first chamber 112. Nozzles 140 are located around the screw hole 112*c*, and a collar 180 with a hole 182 fixed under the bottom 112*a* of the first chamber 112, wherein the ignition cartridge 118 is fixed in the screw hole 112*c* by the collar 180.

Figure 5:
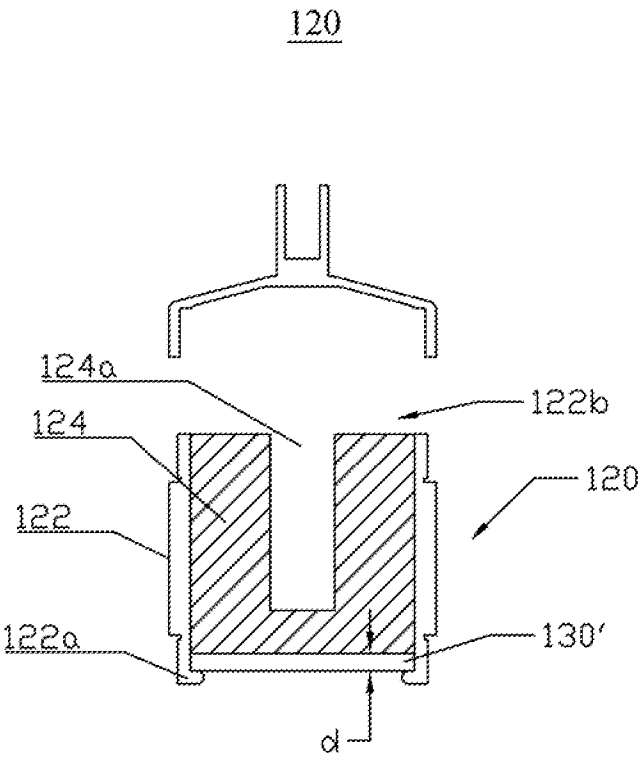
FIG. 5 is a cross-sectional view showing the second section in accordance with a further embodiment of the present disclosure.

FIG. 5 is a cross-sectional view showing the second section 120 in accordance with a further embodiment of the present disclosure. The second propellant 124 may comprise one or more combustion channels 124*a*. Also referring to FIG. 3, the second chamber 122 may comprise a bottom 122*a* with one or more holes 122*c* to allow the combustion passing the bottom 122*a* of the second chamber 122, and the bottom 122*a* of the second chamber 122 may comprise a mounting base 121 for fixing the propellant element 114*b* of the first section 110. By referring to FIGS. 4 and 5, the second chamber 122 may be connected to the open top 112*b* of the first chamber 112 by the bottom 122*a* of the second chamber 122.

While the propulsion system is launched and a person may be stand near the propulsion system or inside a house, the amount of the emitted smoke and heat is required to be decreased to prevent the person from being harmed, the retardant set 130 may be installed between the first propellant 114 and the second propellant 124 to keep the combustion from the first propellant 114 to the second propellant 124, however, with the decreased smoke or heat. For example, by referring to FIG. 5, the retardant set 130 shown in FIG. 2A may be installed in the space 130' over the bottom 122*a* of the second chamber 122.

Optionally, the thickness d of the space 130' for containing the retardant set 130 may be about 1 centimeter by way of example but not limitation. Optionally, the second propellant 124 comprises Sorbitol, Potassium Nitrate, and Iron Oxide, and a ratio of Sorbitol to Potassium Nitrate of the second propellant 124 is about 35 to 65 in weight.

By referring to FIGS. 4 and 5, the combustion channels 114*c* form an exposed surface of the first propellant 114, and the combustion channels 124*a* form an exposed surface of the second propellant 124. Optionally, to increase the lifting power while launching the propulsion system 10, the exposed surface of the first propellant 114 may be more than an exposed surface of the second propellant 124.

Figure 6B:
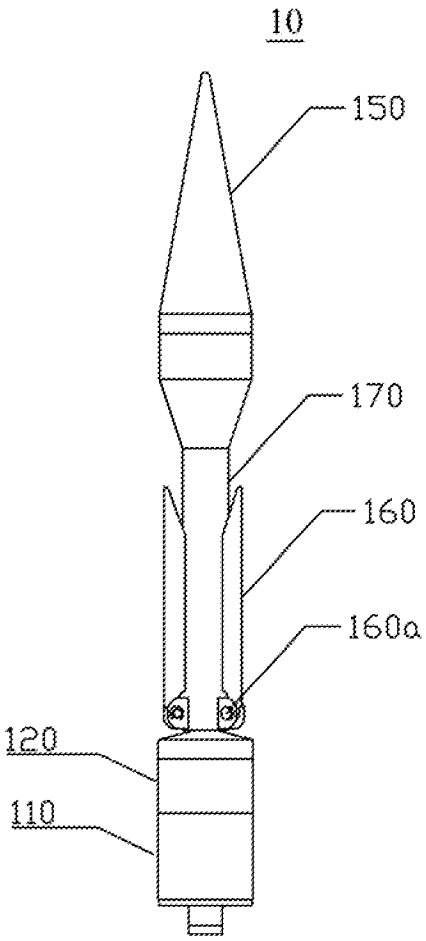
FIG. 6B is a side view showing a propulsion system with folded wings in accordance with other embodiments of the present disclosure.
Figure 6A:
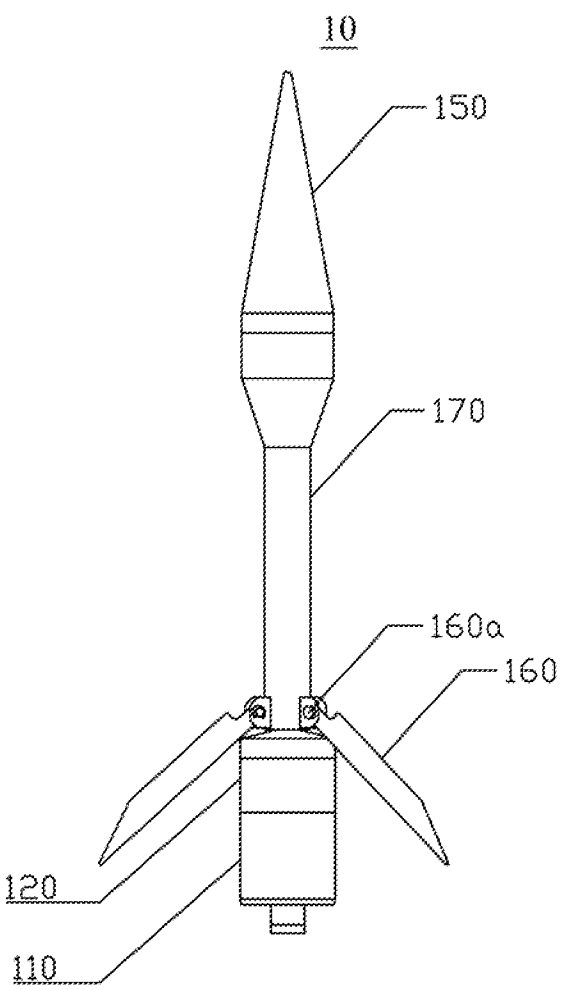
FIG. 6A is a side view showing a propulsion system with unfolded wings.

FIG. 6A is a side view showing a propulsion system 10 with unfolded wings 160 and FIG. 6B is a side view showing a propulsion system 10 with folded wings 160 in accordance with other embodiments of the present disclosure. By referring to FIGS. 6A and 6B, the propulsion system 10 may further comprise a warhead 150 on the body section 170 over the second section 120. Optionally, the propulsion system 10 may further comprise wings 160, which can be folded or unfolded by the axes 160*a*. Therefore, the propulsion system 10 can be put into a launch tube when the wings 160 are folded in FIG. 6B, and have a stable flying path when the wings 160 are unfolded in FIG. 6A.

Figure 7:
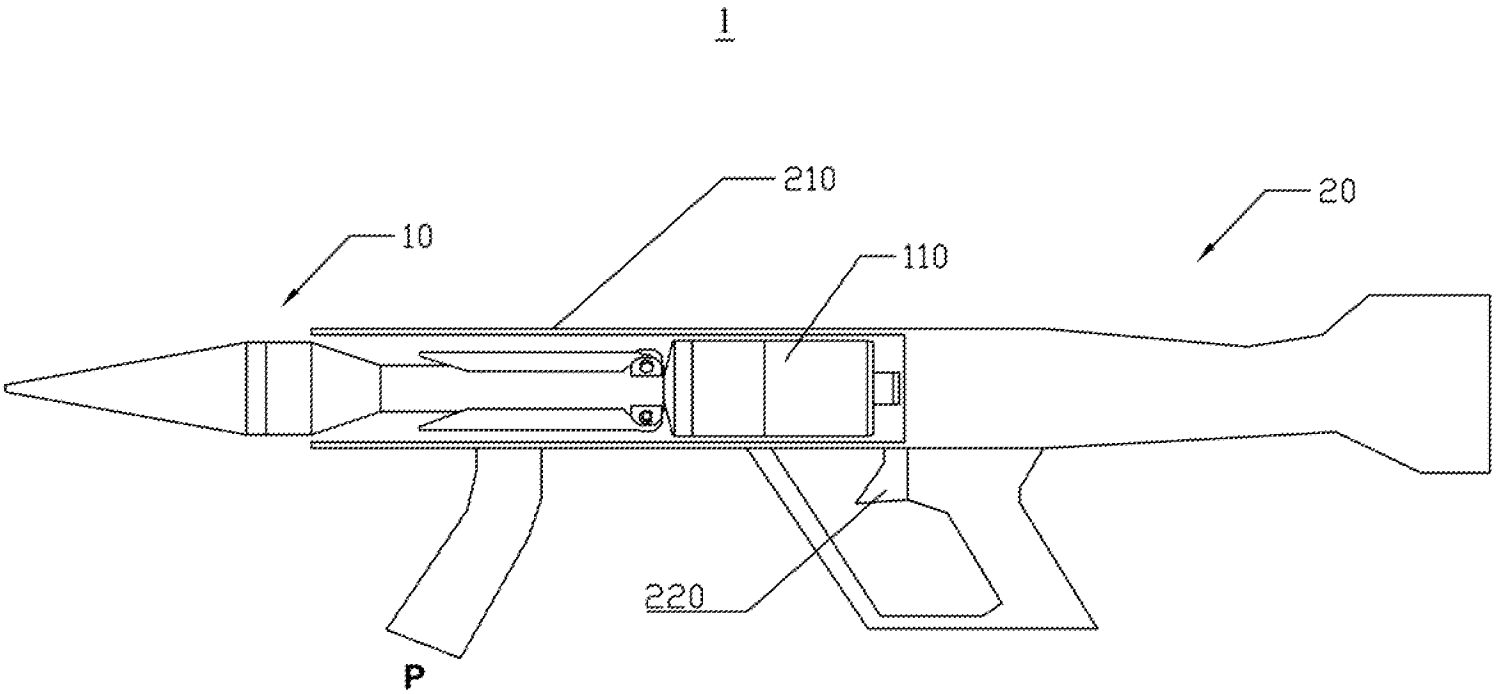
FIG. 7 is a cross-sectional view showing a throwing device in accordance with an embodiment of the present disclosure.

FIG. 7 is a cross-sectional view showing a throwing device 1 in accordance with an embodiment of the present disclosure. The throwing device 1 may comprise a propulsion system 10 and a launcher 20. The launcher 20 may comprise a trigger 220 and a tube 210 for containing the propulsion system 10.

Figure 8:
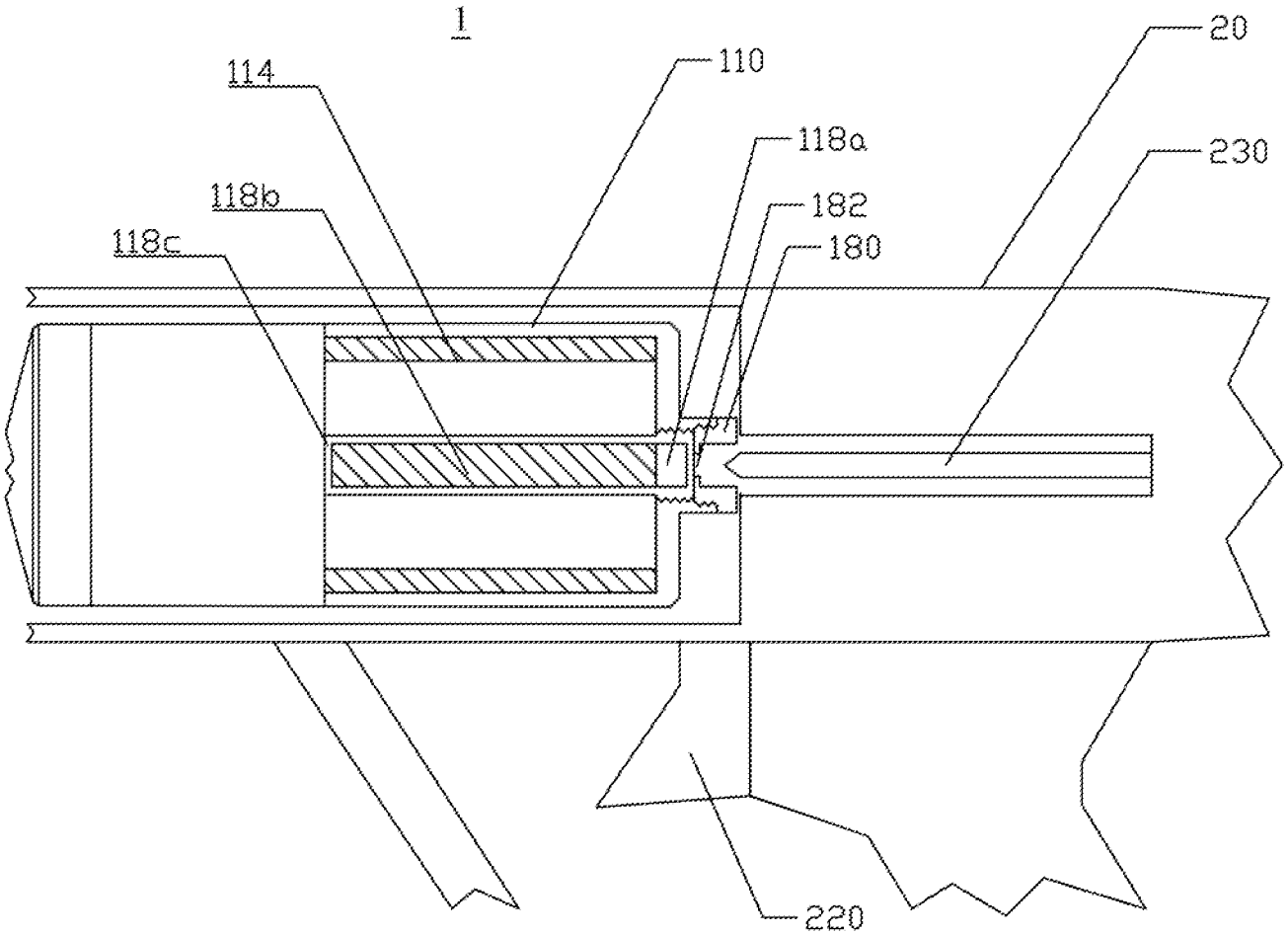
FIG. 8 is a cross-sectional view showing a part of a throwing device in accordance with another embodiment of the present disclosure.

FIG. 8 is a cross-sectional view showing a part of a throwing device 1 in accordance with another embodiment of the present disclosure. The first section 110 of the propulsion system comprises a first chamber 110 containing a first propellant 114, and an ignition cartridge 118 for igniting the propellant element 114*b*. The launcher 20 further comprises a firing pin 230, and the firing pin 230 is triggered by the trigger 220 to hit the ignition cartridge 118 through a hole 182 of the collar 180. After the explosive primer 118*a* of the ignition cartridge 118 is exploded by the firing pin 230, the shell 118*c* is broken and the fire spreads to the first propellant 114.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A throwing device, comprising:

a propulsion system including:

a first section including a first chamber having a first propellant and an ignition cartridge for igniting the first propellant;

a second section connected to the first section and including a second chamber having a second propellant; and a retardant set disposed between the first propellant and the second propellant for delaying combustion from the first propellant to the second propellant, the retardant set including a third propellant, and a dish formed with holes through a surface thereof proximal to the second propellant and for containing the third propellant, and the retardant set further including a mesh covering the dish and the third propellant, wherein the mesh of the retardant set is disposed to face the first propellant, and wherein the dish of the retardant set is disposed to face the second propellant; and a launcher including:

a tube for containing the propulsion system; and a trigger for triggering the ignition cartridge.

2. The throwing device of claim 1, further comprising:

a screw hole formed in a center of a bottom of the first chamber;

nozzles disposed around the screw hole; and a collar formed with a hole and fixed in the screw hole, wherein the ignition cartridge is fixed in the screw hole via the collar.

3. The throwing device of claim 2, wherein the ignition cartridge includes an explosive primer, and the launcher further comprises a firing pin triggered by the trigger to hit the explosive primer.

4. The throwing device of claim 3, wherein the ignition cartridge includes a cartridge propellant.

5. The throwing device of claim 1, wherein the third propellant includes Sorbitol, Potassium Nitrate, and Sodium Bicarbonate, wherein the Sodium Bicarbonate to the Sorbitol and the Potassium Nitrate is about 15 to 100 in weight.

6. The throwing device of claim 5, wherein the Sorbitol to the Potassium Nitrate is about 35 to 65 in weight.

7. The throwing device of claim 1, wherein the retardant set comprises third propellant includes Sorbitol, Potassium Nitrate, and Iron Oxide.

8. The throwing device of claim 1, wherein the first propellant includes one or more combustion channels.

9. The throwing device of claim 1, wherein the second propellant includes one or more combustion channels.

10. The throwing device of claim 1, wherein the first chamber includes an open top and a bottom with holes.

11. The throwing device of claim 10, wherein the second chamber includes a bottom with holes, and the bottom of the second chamber is connected to the open top of the first chamber.

12. The throwing device of claim 11, wherein the retardant set is installed on the bottom of the second chamber.

13. The throwing device of claim 12, wherein a thickness of a space for containing the retardant set is about 1 cm.

14. The throwing device of claim 1, wherein an exposed surface of the first propellant is more than an exposed surface of the second propellant.

15. The throwing device of claim 1, further comprising a nozzle in a bottom of the first section.

16. The throwing device of claim 15, further comprising a space between the nozzle and the first propellant.

17. The throwing device of claim 1, further comprising a warhead over the second section.

18. The throwing device of claim 1, wherein the first propellant includes Sorbitol, Potassium Nitrate, and Iron Oxide, and the second propellant includes Sorbitol, Potassium Nitrate, and Iron Oxide.

19. The throwing device of claim 1, wherein each of the first propellant and the second propellant include Sorbitol and Potassium Nitrate, wherein the Sorbitol to the Potassium Nitrate is about 35 to 65 in weight.

* * * * *